US005938059A

United States Patent [19]

Luburic

[11] Patent Number: 5,938,059

[45] Date of Patent: Aug. 17, 1999

[54] COLLAPSIBLE CONTAINER HAVING SIDEWALLS WITH SLIDABLE HINGE AXES

[75] Inventor: Frano Luburic, Costa Mesa, Calif.

[73] Assignee: Ropak Corporation, Fullerton, Calif.

[21] Appl. No.: 08/784,348

[22] Filed: Jan. 16, 1997

Related U.S. Application Data

[63] Continuation of application No. 08/484,161, Jun. 7, 1995, abandoned.

[51] Int. Cl.[6] ..... B65D 6/22; B65D 6/26

[52] U.S. Cl. ..... 220/6; 220/7; 220/4.32; 220/4.34

[58] Field of Search ..... 217/47, 65, 15; 220/1.5, 6, 4.34, 4.32, 4.33, 7, 4.01, 4.28; 16/337

[56] References Cited

U.S. PATENT DOCUMENTS

| | | | |
|---|---|---|---|
| 489,711 | 1/1893 | Mandioni | 220/7 X |
| 1,039,452 | 9/1912 | Shepard | 217/15 |
| 1,280,629 | 10/1918 | Appleby | 16/337 |
| 1,381,013 | 6/1921 | Rainsford | 217/15 |
| 2,579,655 | 12/1951 | Donald | 220/331 X |
| 3,628,683 | 12/1971 | Friedrich | 220/6 |
| 3,747,794 | 7/1973 | Bitney | 217/47 X |
| 4,063,330 | 12/1977 | Triplette | 16/321 |
| 4,186,841 | 2/1980 | Buckley et al. | 220/7 X |
| 4,192,430 | 3/1980 | Cornou | 220/331 X |
| 5,094,356 | 3/1992 | Miller | 220/7 |
| 5,150,806 | 9/1992 | Glomski | 220/331 |
| 5,501,353 | 3/1996 | Warren | 217/15 X |

FOREIGN PATENT DOCUMENTS

| | | | |
|---|---|---|---|
| 80400 | 10/1961 | France | 220/7 |
| 2272907 | 12/1975 | France | 220/7 |
| 135488 | 11/1933 | Germany | 220/331 |
| 0323908 | 5/1970 | U.S.S.R. | 16/337 |

*Primary Examiner*—Stephen Castellano
*Assistant Examiner*—Niki M. Eloshway
*Attorney, Agent, or Firm*—J. Mark Holland

[57] ABSTRACT

A hinge is provided to affix members to each other and permit a the members to be moved relatively to each other transversely of the hinge axis while remaining hinged to each other. A collapsible container assembly utilizing such hinges is provided, in which a plurality of sidewall members hinged to a base member can be collapsed onto the base member and each other in a stacked arrangement with the resulting height of the stack being the same regardless of which of several stacking orders is utilized. Leave members of the hinge include slot means axially aligned to permit a hinge pin disposed therein to slide transversely of the longitudinal hinge axis while maintaining the hinged relationship of the members.

23 Claims, 6 Drawing Sheets

COLLAPSIBLE CONTAINER HAVING SIDEWALLS WITH SLIDABLE HINGE AXES

This application is a continuation of application Ser. No. 08/484,161, filed on Jun. 7, 1995, now abandoned.

BACKGROUND OF THE INVENTION

This invention relates to hinges and collapsible containers in general, and specifically to an improved collapsible container.

In the materials handling and other industries, it can be beneficial to use collapsible containers to transport and store objects and materials. Among other things, such containers can be erected to hold things in a relatively secure manner during transport or storage, and can be collapsed during non-use to minimize the space occupied by the container. Commonly, such containers are provided in reusable, stackable configurations, to further improve their usefulness. An example of containers of this type is illustrated in U.S. Pat. No. 4,917,255 to Foy et al. Drawings from that patent are included herein as FIGS. 1–8, to illustrate certain aspects of prior art containers.

In a common application for such containers, the containers are erected and filled with parts to be used (for example) on an assembly line. A plurality of erected containers are stacked atop one another and loaded into a semi-trailer, which transports them to the location of the assembly line. Upon arrival there, the containers are positioned beside the assembly line adjacent the location at which the parts are to be used. Once a container is emptied of parts, it is collapsed and set aside. The collapsed containers can be gathered together and returned to the parts supplier (or to another supplier) in the collapsed state, where the entire cycle can then be repeated.

In such an application, it is beneficial for such containers to have a high "return ratio". This ratio is the number of collapsed containers that occupies the same space as one erected container. The name "return ratio" is thus apparently derived from an application such as the foregoing, in which the focus is on "returning" the maximum number of collapsed containers (to eventually be refilled by the parts supplier) in the smallest space. By returning a greater number of containers in a given space, the number of shipments required to transport the empty, collapsed containers is thereby reduced. Correspondingly, the amount of space required to store the empty, collapsed containers is reduced, both before and after shipment. Thus, collapsible containers with a relatively high return ratio (current "good" ratios are currently typically 3:1) are in many applications more economical to use and store than are containers with lower return ratios.

In addition, however, the efficiency, speed, quality and profitability of many applications (including those similar to the aforementioned assembly line application) can be improved by simplifying the processes and time required to erect and collapse the containers. To the extent that the containers can be collapsed by the assembly line workers without a great deal of physical effort or mental concentration, the workers can instead focus that effort and concentration on the actual assembly work (hopefully improving that work product). A common configuration which allows rapid erection and collapse is a rectangular or square base and four interlocking sidewalls, each hinged to a side of the base so that the sidewalls fold over the base into a parallel, stacked relationship.

In many prior art containers of this type, these two factors (return ratio versus speed or efficiency) have been a tradeoff.

For example, when the required or desired height of the erect container is more than half the width of the container base, and when the walls are hinged to the base along a hinge line near the base itself, opposing pairs of walls cannot be collapsed without overlapping each other. This problem has been resolved in prior art containers in two primary ways, each exemplifying a different balance of the two factors.

In the first approach, each hinge line is raised away from the base. This is done by integrally molding onto the edge of the base what is equivalent to a portion of the erected sidewall. Because it is integrally molded and is not hinged but is instead fixed to the base, this portion cannot be collapsed, and it therefore typically makes the collapsed container taller than it otherwise might be (it reduces the "return ratio" because it spaces the collapsed walls away from the base). Because it reduces the height of the foldable portion of the sidewall, however, it permits the sidewalls to be folded in a relatively simple manner (without overlapping). In other words, moving the hinge line up the side of the container makes it easier to collapse the container (because the collapsed wall portions do not overlap and therefore do not have to be collapsed in any specific order) but prevents the containers from being collapsed as compactly as if the hinge line were nearer the base.

In the second approach, the hinge lines are staggered in distance from the base as compactly as permitted by the thicknesses and configurations of the sidewalls. In other words, the portion of the erected sidewall that is integrally molded onto the edge of the base is minimized. In the overlapped collapsed wall situation, the maximum overall compaction of the container normally occurs if the four collapsed sidewalls are effectively "stacked" on each other and the stack is directly against the base. To accomplish this, the four hinge lines are typically spaced from the base in increments of approximately the thickness of the sidewalls, each of the four hinge lines being progressively further from the base. The tradeoff in this design is that the walls must be collapsed in the specific order in which the hinges are positioned, in order to accomplish the desired "stacking" result (or sometimes even to permit all four of the walls to be collapsed at all). This can make the collapsing process relatively more complicated and slower than in designs in which the walls can be collapsed in any order.

This latter problem is somewhat reduced in designs such as the aforementioned U.S. Pat. No. 4,917,255 because one pair of opposing walls interfits with the other pair such that it is easy for users to see that the first pair must be released and collapsed before the other pair. In that patent, for example, the walls 16 and 18 in its FIG. 1 must be released from their engagement at the corners and then collapsed before the walls 20 and 22 can be collapsed on top of them (see FIG. 14 of that patent [similar to FIG. 2 in this application] for an illustration of all four sidewalls in a collapsed condition). Even the type of design in U.S. Pat. No. 4,917,255 requires, however, that a specific wall of each opposing pair be lowered before the other of the pair (thus, in FIG. 1 of the foregoing patent, wall 16 must be lowered before wall 18, and wall 20 before wall 22). This is conveniently described as sequential folding. Although sequential folding maximizes the return ratio for a given configuration of container, sequential folding requires more concentration and effort to manipulate the container into its collapsed condition, and is therefore less efficient in assembly-line processes (and can even be more time-consuming to collapse) than containers in which there is no wall overlap.

If the sidewalls are not collapsed in the precise order required, the containers (including their hinges and other components) can be damaged by assembly line workers who sometimes try to force the sidewall members flat against the base member.

Another drawback of the sequential folding approach is that, in order to provide a container with a uniformly tall top edge when the sidewalls are erect, each sidewall member must be manufactured to its own specific dimensions. In other words, each sidewall member will be a different height and shape than the other sidewall members, because of the four different distances between the hinge pins and the top edge of the erect container. This requires additional investment in manufacturing capacity (for example, four separate sidewall molds must be built and used for injection molded, blow-molded and similar embodiments) and in inventory and distribution (again, four different types of sidewalls must be inventoried and controlled for distribution, assembly, replacement and repair).

Other applications and devices employing hinges or hinged members are similarly limited by the relatively fixed position of the pivot axis of the hinge. Negative effects (such as the need for sequential folding, a reduced return ratio, or the like) result from this limitation.

Objects and Advantages of the Invention

It is, therefore, an object of my invention to provide a hinge means to affix members to each other and permit the members to be moved relatively to each other transversely of the longitudinal hinge axis while remaining hinged to each other. The hinge means of my invention is characterized by the members having leave members with aligned hole means in which hinge pin means is disposed, with the hole means including slot means to permit the desired transverse movement. The hinge pin means of my invention can be in any of a wide variety of configurations, including, for example, a single elongated hinge rod passing through all the aligned hole means on a given sidewall, a plurality of rod members passing through the aligned hole means on a given sidewall, and molding or attaching pin members onto the sidewall itself, in the form of one or more projecting members configured to engage the hole means. The concept of such projecting members is illustrated, for example, in U.S. Pat. No. 4,674,647, at FIG. 9 thereof.

A further object of my invention is the provision of a collapsible container assembly utilizing hinges of the aforementioned character. In the common collapsible container assembly line application described above, my invention reduces the sequential limitations for collapsing the container (and can virtually eliminate the mental concentration required to properly collapse the container; the container can virtually automatically collapse in the proper order once the walls are disengaged from each other) but provides the maximum available return ration (or at least the same return ratio as comparable prior art containers).

An additional object of my invention is the provision of a collapsible container of the aforementioned character, in which sidewall and base components of the erected container are effectively interlocked with each other to a similar degree as prior art containers. In many applications it would be undesirable for the sidewalls to be transversely slidable with respect to their hinge axis when they are erected. Among other things, such movement in the erected position might occur during transportation of the filled container, and might cause a stack of such containers to become unstable and possibly fall or rock undesirably, and/or bind or damage some of the product being carried in the container. A preferred embodiment of such interlocking means is described below as interfitting mortise and tenon members.

Yet another object of my invention is the provision of a collapsible container of the aforementioned character, in which the erected container is stackable with similarly sized and shaped containers.

An additional object of my invention is the provision of a collapsible container of the aforementioned character, in which opposing pairs of sidewalls are interchangeable with each other. As indicated above, this reduces the design, investment and maintenance costs for manufacturing, inventorying, assembling, repairing and distributing the containers. This same benefit attaches to many other applications in which the variety of components required to complete the assembly is reduced.

Another object of my invention is the provision of a collapsible container having a base member and a plurality of sidewall members hinged to the base member so that the sidewall members can be moved between an overlapping collapsed position and an erect position, including hinge means for hinging each the sidewall member to the base member, the hinge means permitting the sidewalls to be collapsed into the overlapping position in various orders. In other words, the precise sequence of folding the sidewalls during collapse would not be as specific as in prior art containers. In certain embodiments similar to that shown in the aforementioned U.S. Pat. No. 4,917,255, there are spring-actuated latches to hold each comer of the erected sidewalls in the erected position. By incorporating my invention into such containers, the sidewalls can automatically collapse in the proper order simply by releasing those latches.

A further object of my invention is the provision of hinge means of the aforementioned character, in which the hinge pin means is slidable within the slot means to permit the hinged members to be pivoted relative to each other at any of a range of positions along the slot means.

Yet another object of my invention is the provision of hinge means of the aforementioned character, in which the hinge pin means is constituted by a plurality of axially aligned hinge pins.

Other objects and advantages of the invention will be apparent from the following specification and the accompanying drawings, which are for the purpose of illustration only.

DESCRIPTION OF PREFERRED EMBODIMENT

Figure 1:
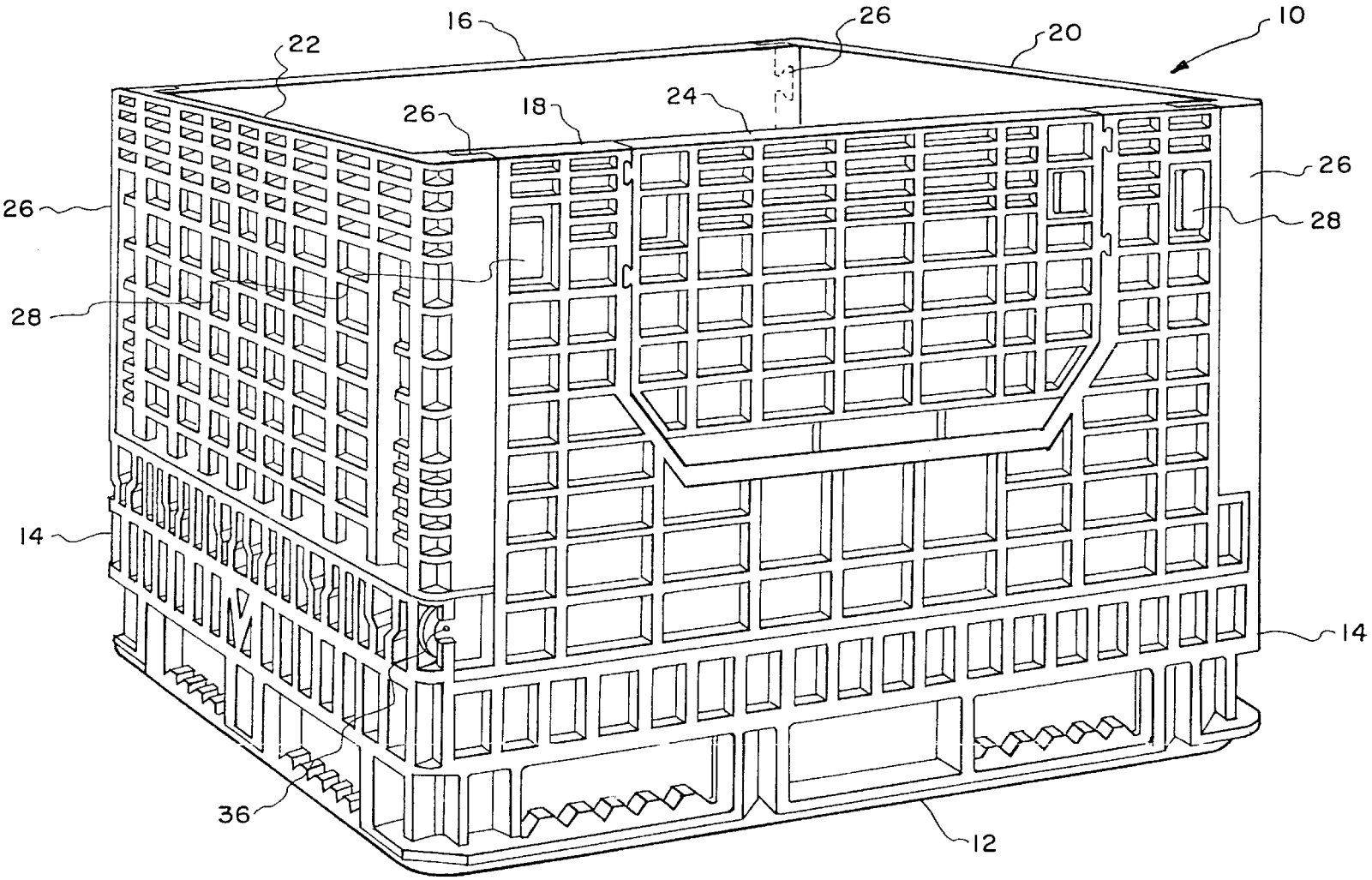
Fig. 1. PRIOR ART
FIG. 1 is an isometric view of a prior art collapsible container with its sidewall members in an erect position.

Referring now to the drawings, and particularly to FIGS. 1–8 thereof, I show a typical prior art collapsible container 10. As indicated above, these drawings are similar to some in U.S. Pat. No. 4,917,255, and the function of the various components is explained in additional detail in that patent. Such containers are typically fabricated from blow-molded or injection-molded plastic such as polyethylene, but may be of any suitable material. Examples of such other suitable materials include, without limitation, wood, metal, rubber, glass, fiberglass, etc. The rod (such as one of the hinge pins 30, 32, 34 and 36 discussed below) utilized to hingedly attach the sidewalls to the base is preferably fabricated from fiberglass or other pultruded materials, but could be formed from metal or any other suitable material. Except where otherwise indicated herein, the preferred materials for my invention are similar to those of such prior art devices.

The container includes a base member 12 having a plurality of sides 14. Sidewall members 16, 18, 20 and 22 are hinged to the base member 12 at each of its sides 14. One or more drop doors 24 may be provided in the sidewall members to improve accessibility to the interior of the container when it is in the erected position.

Interfitting webs and flanges 26 are provided on the edges of the sidewall members to provide stability to the erected container. Latches 28 (such as spring-actuated latch members) hold the sidewall members in the erected position. The release of the latches 28 permits the sidewall members to be disengaged from each other and collapsed.

Figure 2:
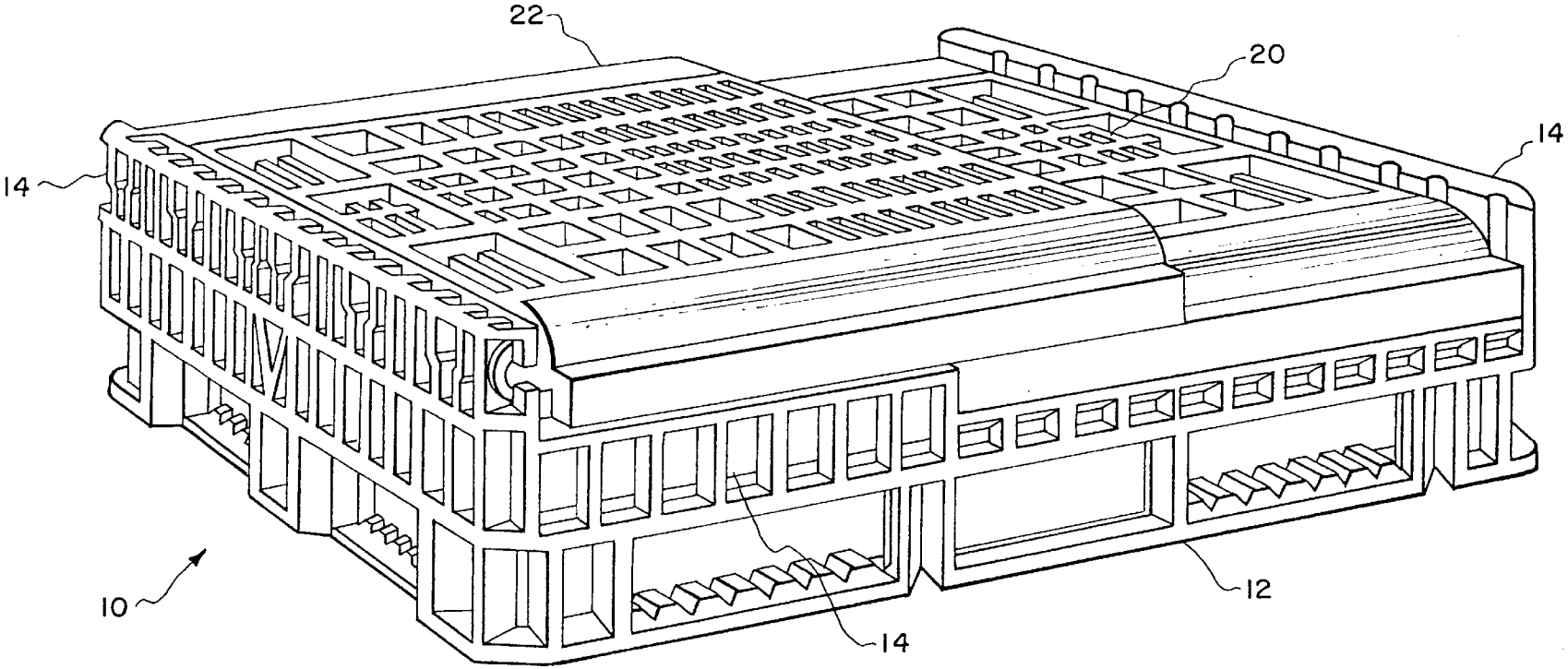
Fig. 2. PRIOR ART
FIG. 2 is an isometric view of the prior art collapsible container of FIG. 1, with its sidewall members in a collapsed position.
Figure 3:
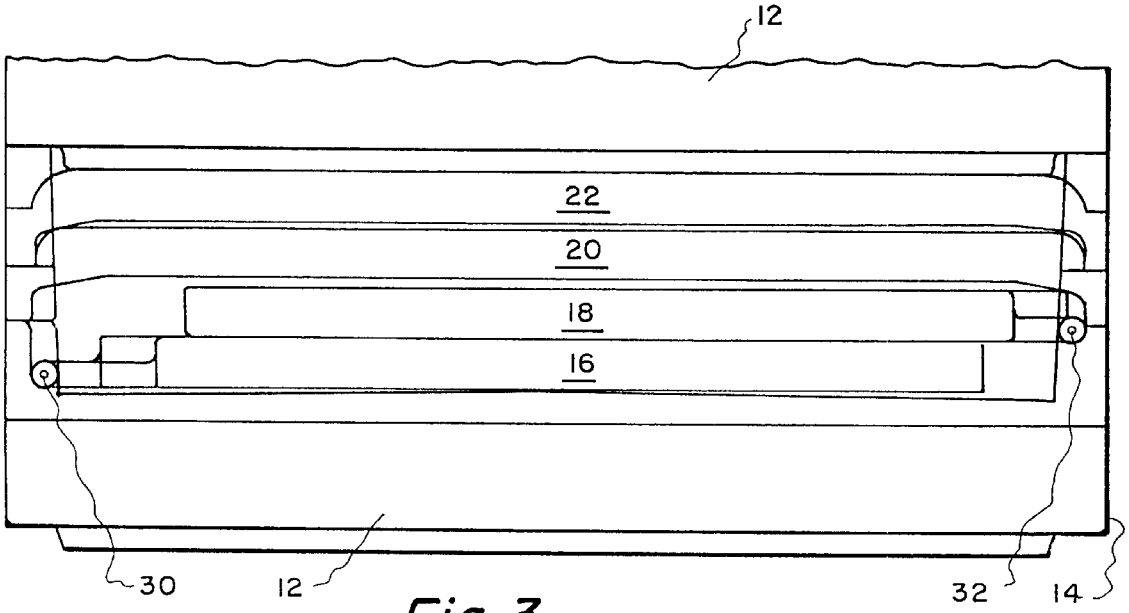
Fig. 3. PRIOR ART
FIG. 3 is a side view of the prior art collapsible container of FIG. 2, illustrating the stacking of the sidewall members with respect to the base member and each other, and with a partial broken view of a similar container stacked thereon.
Figure 4:
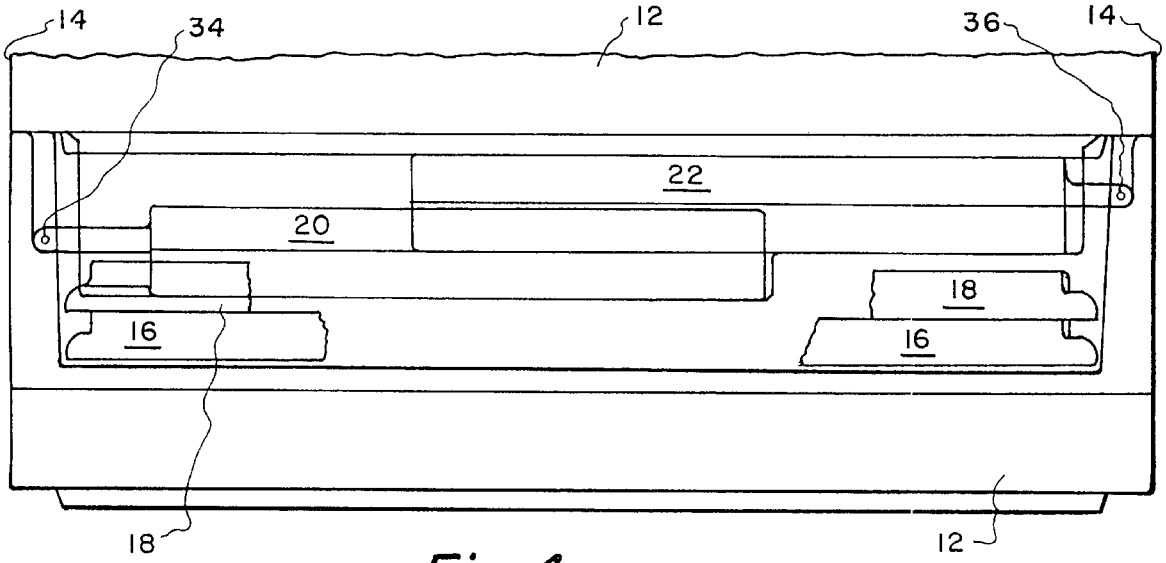
Fig. 4. PRIOR ART
FIG. 4 is similar to FIG. 3, but illustrates the view from an adjacent side of the collapsed container.

The collapsed position is illustrated in FIGS. 2–4. As illustrated, because of the respective heights of the sidewall members and the width of the base member, the sidewalls overlap in the collapsed position. In order to lie flat in the most compact collapsed arrangement, the sidewall members must be collapsed in the specific order of sidewall member 16, sidewall member 18, sidewall member 20 and finally sidewall member 22. To accomplish this compact collapsed arrangement, hinge pins 30, 32, 34 and 36 attaching the respective sidewall members 16, 18, 20 and 22 are spaced at staggered distances from the base member 12.

Figure 5:
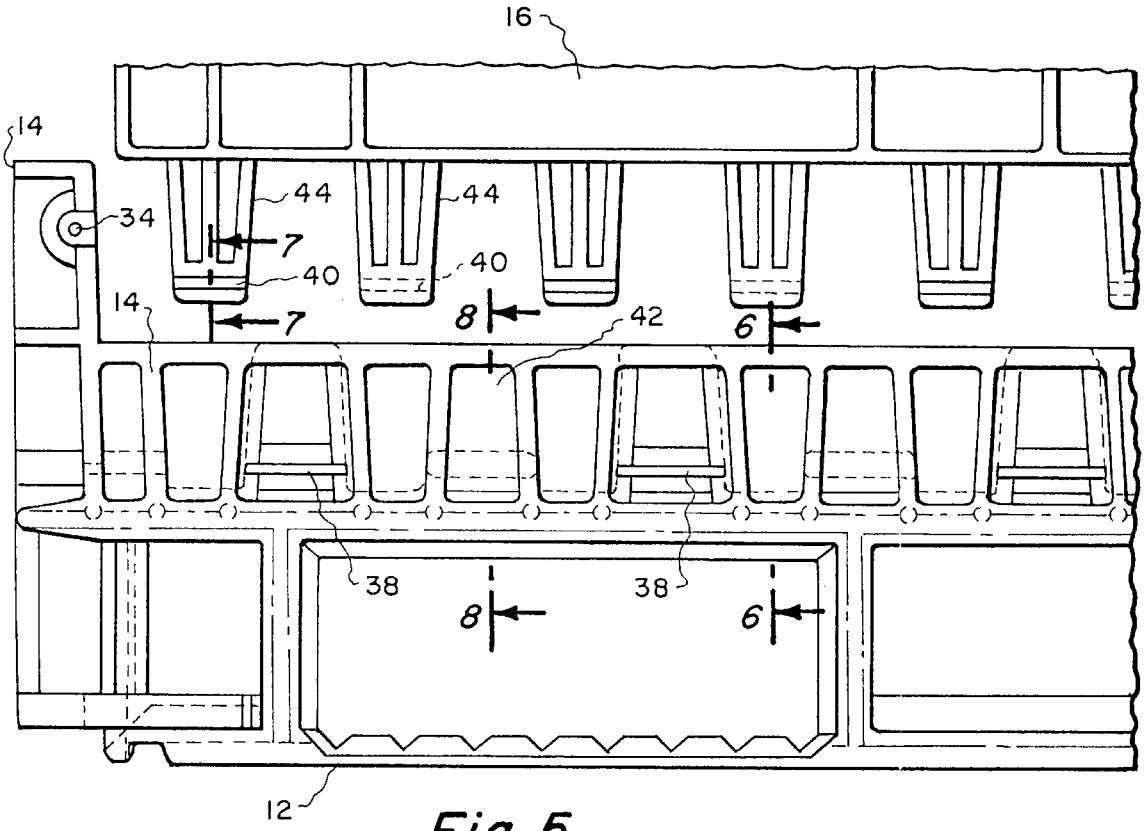
Fig. 5. PRIOR ART
FIG. 5 is an elevation view of a portion of the base member and a sidewall member of the prior art collapsible container of FIG. 1, prior to assembly of those members to each other with hinge pin means.
Figure 6:
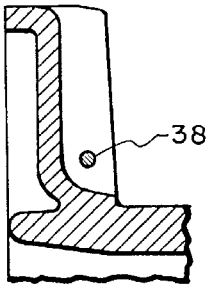
Fig. 6. PRIOR ART
FIG. 6 is a sectional view taken along line 6—6 of FIG. 5.
Figure 7:
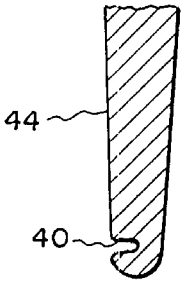
Fig. 7. PRIOR ART
FIG. 7 is a sectional view taken along line 7—7 of FIG. 5.
Figure 8:
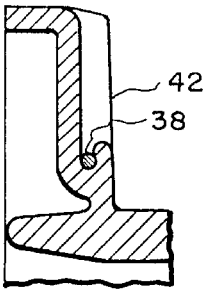
Fig. 8. PRIOR ART
FIG. 8 is a sectional view taken along line 8—8 of FIG. 5.

The positions of these hinge pins 30, 32, 34 and 36 with respect to the base member 12 are relatively fixed, in that they are disposed through axially aligned holes 38 on the base member 12 (FIGS. 5, 6 and 8) and correspondingly aligned holes 40 on each respective sidewall member (FIGS. 5 and 7). These holes 38 and 40 are commonly provided in interfitting hinge tangs or leaf members 42 and 44, respectively. The holes or troughs 40 on the sidewall members alternate in direction (in and out of the page as shown in FIG. 5) so that, when each sidewall is assembled at its appropriate location on the base member 12 and the respective hinge pin is passed through the aligned holes 38 and 40, the sidewall cannot be separated from the base member 12 without removal or destruction of the hinge pin.

The prior art container 10 is typically injection molding from plastic or other suitable material, although other processes and materials can be used. Persons of ordinary skill in the art will understand that, as described herein, the preferred embodiment of the present invention may be fabricated from similar materials and from similar processes, as well as from other materials and processes, so long as the embodiment functions as described hereinbelow.

A preferred embodiment of the container of my invention is similar to that just described for the prior art container 10. Several important differences between the prior art container and a preferred embodiment of my invention are illustrated in FIGS. 9–14.

Figure 9:
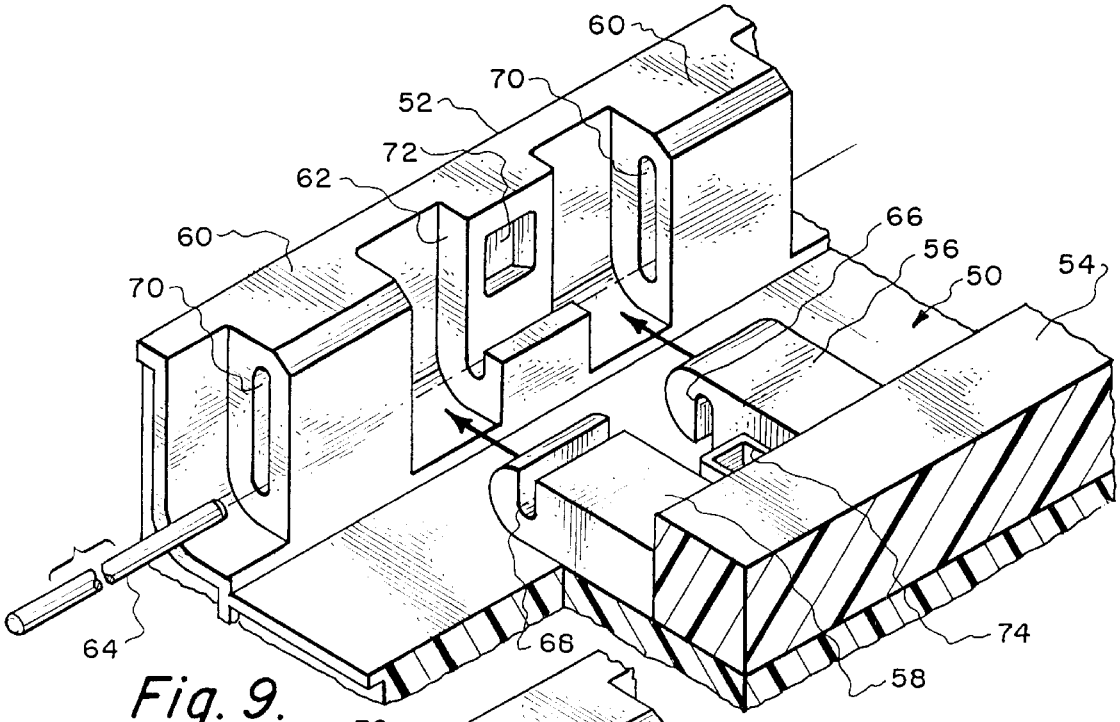
FIG. 9 is an isometric view of a preferred embodiment of a portion of a collapsible container utilizing hinge means in accordance with the teachings of my invention, including a base member, a sidewall member, and hinge pin means prior to their assembly together.

In FIG. 9, a base member 50 includes side portions 52 extending therefrom. A sidewall member 54 includes one or more tangs or leaf members 56 and 58 positioned and configured to interfit with tangs or leaf members 60 and 62 on the base side portions 52. After the sidewall members are properly positioned (so that the leaf members 56 and 58 are between leaf members 60 and 62 on the base side portions 52), hinge pin means such as a hinge rod 64 is inserted through one or more holes or openings 70 in the leaf members 60 and through holes or openings 66 and 68 in the leaf members 56 and 58, respectively. The holes or openings 70 are preferably in the form of a straight slot (although curved slots or other openings might also be useful). After the hinge rod 64 is so inserted, it may be retained in the desired assembled positioned by affixing lock washers to each end (or by using other suitable means of retention).

As indicated above, the hinge pin means of my invention can be provided in any of a wide variety of configurations, including the preferred single elongated hinge rod 64 passing through all the aligned hole means on a given sidewall. Among the many alternative embodiments are a plurality of shorter rod members (not shown) passing through the aligned hole means on a given sidewall, and providing molded pin members or attaching pin members onto the sidewall itself, in the form of one or more projecting members configured to engage the hole means. This latter concept of molded projecting members is illustrated, for example, in U.S. Pat. No. 4,674,647, at FIG. 9 thereof.

Figure 10:
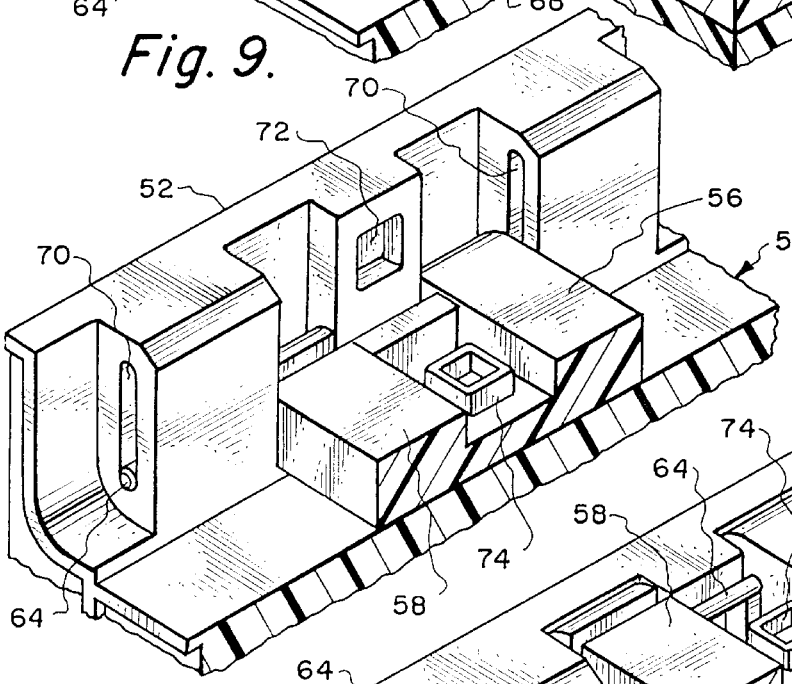
FIG. 10 is similar to FIG. 9, but illustrates the components after their assembly together.
Figure 10A:
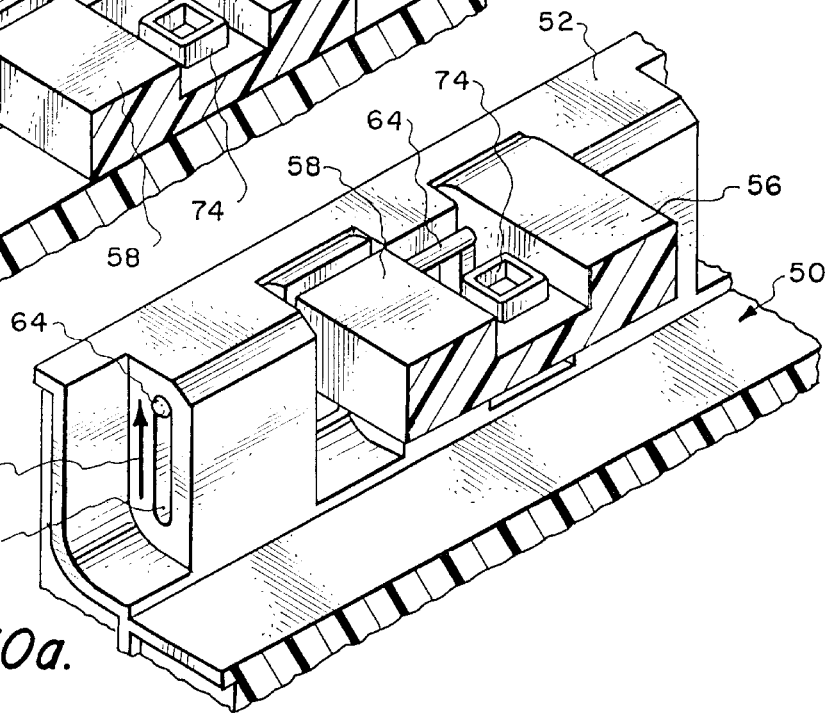
FIG. 10*a* is similar to FIG. 10, but illustrates the sidewall member and hinge pin means slid in the direction of the arrow U.

The slot 70 is preferably sized to permit ready transverse movement of the hinge pin 64 in the direction indicated by the arrow U in FIG. 10*a* and the direction opposite thereto. This movement is illustrated in FIGS. 10 and 10*a*, showing the same structure and components but with the hinge pin means 64 at opposite ends of the slot 70. This results in the non-sequential folding order illustrated in FIGS. 13 and 14, which show that either of the two sidewall members 54 could be collapsed or folded before the other (or could be allowed to fall) without affecting the overall height of the collapsed assembly. As discussed above, in some embodiments, the comer latches can be disengaged and the sidewall members released, and the sidewall members will "automatically" fall into the optimum return ratio for the container.

As indicated above, it is sometimes desirable for collapsible containers of this type to be relatively solid and non-shifting when erected. To limit the aforementioned movement of the hinge pin 64 in the direction indicated by the arrow U in FIG. 10*a* and the direction opposite thereto when the sidewall member 54 is erected, the preferred embodiment of my invention includes interlocking means such as a mortise 72 in the base member side portion 52, and corresponding tenon 74 on the sidewall member 54. The interlocking means can be provided in a wide range of shapes, sizes, and arrangements, but is conveniently illustrated in the drawings as preferably having a substantially rectangular configuration with a wall thickness suitable for injection molding. By way of example and not limitation, the mortise could instead be provided on the sidewall member, and/or could include a plurality of mortises of triangular and circular configurations. The interlocking means (or some part thereof) may be provided as solid plugs rather than thin-walled structures shown in the drawings. Among the many additional alternative embodiments are separately attachable interlocking members, which are not integrally molded or formed as part of the sidewall or base, but instead are operatively affixed by glue, adhesive, screws, welding, fasteners or other expedient.

Figure 11:
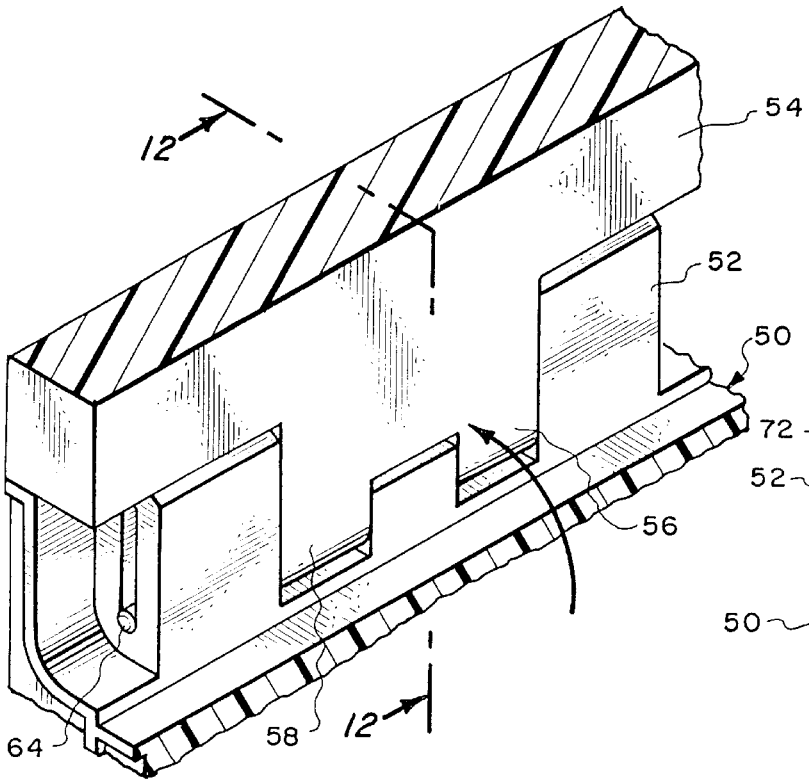
FIG. 11 is similar to FIG. 10, but illustrates the sidewall member in an erect position.
Figure 12:
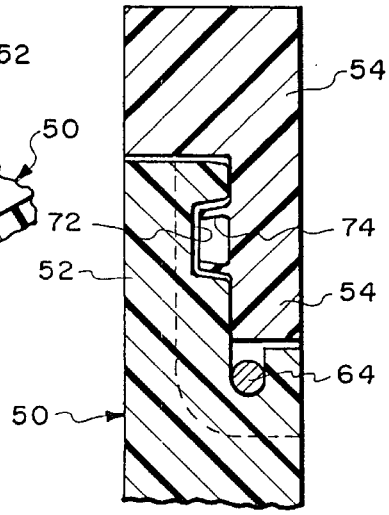
FIG. 12 is a broken sectional view taken along line 12—12 of FIG. 1, illustrating a preferred embodiment of the interlocking means of my invention.
Figure 13:
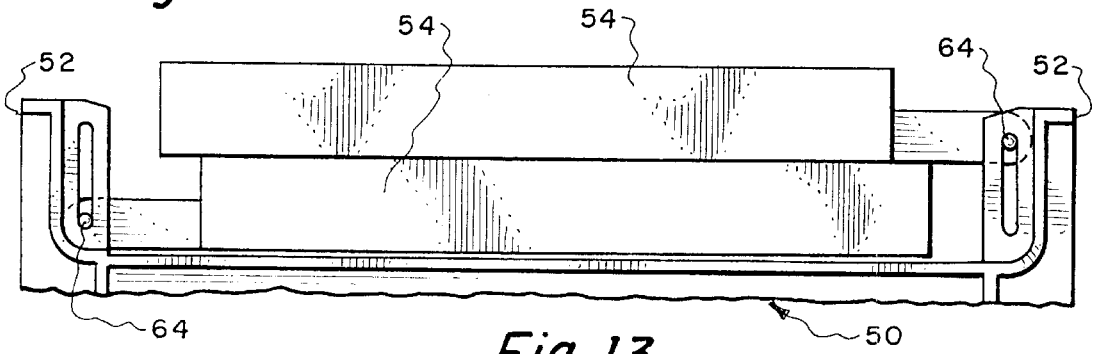
FIG. 13 is a side view of a preferred embodiment of a collapsible container showing two sidewall members in collapsed position over the base member.
Figure 14:
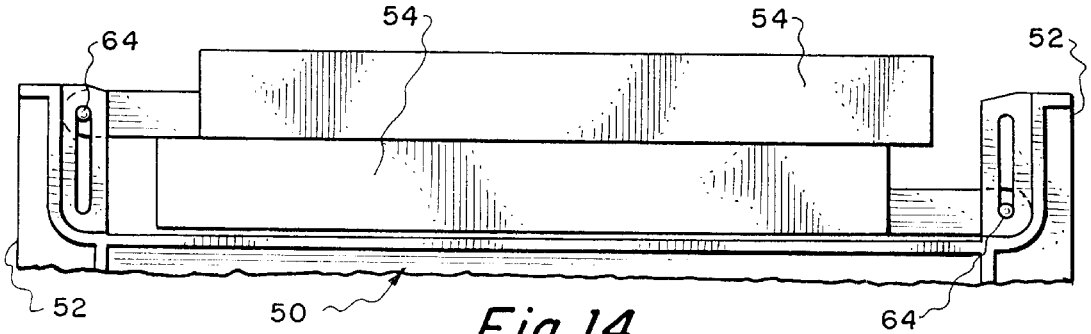
FIG. 14 is similar to FIG. 13, but illustrates a different folding sequence for the sidewall members.

The erected sidewall member 54 is illustrated in FIGS. 11 and 12. As shown in FIG. 12, the interlocking means may be provided in a tapered cross-sectional configuration, to facilitate engagement of the mortise and tenon as the sidewall member 54 is raised into the erect position.

By precise positioning of the interlocking means on each respective sidewall member, the position of the top edge around the entire erected container (not shown) can be controlled. Normally, this top edge is desired to be of uniform height (similar to that shown as FIG. 1 for the prior art) to facilitate stacking of a plurality of containers.

Because of the slidable nature of the hinge of my invention, opposing members of a device in which it is used (such as opposing sidewall members in a collapsible container) can be provided in interchangeable (and even identical) shapes and sizes. If interlocking means such as mortise and tenon are also utilized, they would preferably also be interchangeably positioned, sized and shaped to facilitate the interchangeability of the sidewall members. As indicated above, this interchangeability has numerous economic benefits.

Thus, by my invention, I provide a hinge means useful in, among other things, collapsible containers in which opposing sidewalls are dimensioned and configured so that they overlap when collapsed. Among the many alternative embodiments and applications in which my invention may be useful are containers having non-rectangular shapes and/or more than four sides (such as hexagonal bases, octagonal bases, etc.).

The apparatus of my invention has been described with some particularity but the specific designs and constructions disclosed are not to be taken as delimiting of the invention in that various modifications will at once make themselves apparent to those of ordinary skill in the art, all of which will not depart from the essence of the invention and all such changes and modifications are intended to be encompassed within the appended claims.

I claim:

1. A collapsible container having a base member and a plurality of sidewall members hinged to said base member, said sidewall members being movable between an erect position and an overlapping collapsed position, said collapsed position being one in which said sidewall members are in planes substantially parallel with each other and at least one pair of opposing said sidewall members overlap each other, including hinge means for hinging each said sidewall member to said base member, said hinge means permitting said sidewall members to be collapsed into said overlapping position in various orders, said hinge means including at least one leave member formed in at least one of said sidewall members, and said at least one leave member includes a hole therein, and said hinge means further includes a hinge pin member disposed through a slot on said base member and through said hole, said hinge pin member being slidable within said slot to permit translational movement of said at least one sidewall member with respect to said base member when said at least one sidewall member is in other than its erect position and to permit said at least one sidewall member to be pivoted relative to said base member at any of a range of positions along said slot, further including interlocking means between said base member and/at least one of said sidewall members to eliminate translational movement between said at least one sidewall member and said base member when said at least one sidewall member is in said erect position, said interlocking means between said at least one sidewall member and said base member being disengaged by rotation of said at least one sidewall member toward said base member and not requiring translational movement of said at least one sidewall member with respect to said base member to achieve said disengagement.

2. The container of claim in which said hinge means comprises a plurality of axially aligned hinge pins.

3. The container of claim 1 or claim 2, in which said hinge means for hinging each said sidewall member to said base member includes at least one removable hinge pin.

4. The container of claim 1 claim 2, in which said interlocking means constitutes at least one pair of cooperating, interfitting mortise and tenon members on said base member and said at least one sidewall member.

5. The container of claim 4, in which said at least one pair of interfitting mortise and tenon members include a mortise member formed in said base member and a correspondingly configured and positioned tenon member formed in said at least one sidewall member, in which rotating said at least one sidewall member away from said erect position disengages said tenon member from said mortise member.

6. The container of claim 5, in which said sidewall members and said base member are fabricated from plastic.

7. A collapsible container having a base member and a plurality of sidewall members hinged to said base member, said sidewall members being movable between an erect position and an overlapping collapsed position in which said sidewall members are in planes parallel with each other and at least one pair of opposing said sidewall members overlap each other, including hinge means for hinging each said sidewall member to said base member, s aid hinge means permitting said sidewall members to be collapsed into said overlapping position in various orders, said hinge means including at least one leave member formed in at least one of said sidewall members, and said at least one leave member includes a hole therein, and said hinge means further includes a hinge pin member disposed through a slot on said base member and through said hole, said hinge pin member being slidable within said slot to permit translational movement of said at least one sidewall member with respect to said base member when said at least one sidewall member is in other than its erect position and to permit said at least one sidewall member to be pivoted relative to said base member at any of a range of positions along said slot, further including interlocking means between said base member and said at least one of said sidewall members to eliminate translational movement between said at least one sidewall member and said base member when said at least one sidewall member is in said erect position, said interlocking means between said at least one sidewall member and said base member being disengaged by rotation of said at least one sidewall member toward said base member and not requiring translational movement of said at least one sidewall member with respect to said base member to achieve said disengagement.

8. The container of claim 7, in which said hinge means comprises a plurality of axially aligned hinge pins.

9. The container of claim 7 or claim 8, in which said hinge means for hinging each said sidewall member to said base member includes at least one removable hinge pin.

10. The container of claim 7 or claim 8, which said interlocking means constitutes at least one pair of cooperating, interfitting mortise and tenon members on said base member and said at least one sidewall member.

11. The container of claim 10, in which said at least one pair of interfitting mortise and tenon members include a mortise member formed in said base member and a correspondingly configured and positioned tenon member formed in said at least one sidewall member, in which rotating said at least one sidewall member away from said erect position disengages said tenon member from said mortise member.

12. The container of claim 11, in which said sidewall members and said base member are fabricated from plastic.

13. A collapsible container having a base member and a plurality of sidewall members hinged to said base member, said sidewall members being movable between an erect position and an overlapping collapsed position in which said sidewall members are in planes parallel with each other and at least one pair of opposing said sidewall members overlap each other, including hinge means for hinging each said sidewall member to said base member, said hinge means permitting said sidewall members to be collapsed into said overlapping position in various orders, said hinge means including one or more pin members fixed against translational movement with respect to at least one of said sidewall members, said one or more pin members each having a single respective longitudinal axis, with a respective portion of each of said one or more pin members on said respective longitudinal axis being disposed in a respective slot on said base member, said one or more pin members being slidable within said respective slots to permit said at least one sidewall member to be pivoted relative to said base member at any of a range of positions along said slot, further including at least one latch member acting between adjacent sidewall members to interlock said adjacent sidewall members to each other in said erect position; said at least one latch member positioned and configured so that disengagement of said at least one latch member results in disengagement of said adjacent sidewall members from each other without translating either of said adjacent sidewall members with respect to said base member, and said hinge means is configured to permit said at least one sidewall member to pivot toward said base member upon disengagement of said at least one latch member, without first translating said at least one sidewall member away from said base member.

14. Apparatus for hinging two objects to each other, including first and second hinged members, said first hinged member having one or more leave members with a hinge pin member having a longitudinal axis, said hinge pin member having a first portion on said longitudinal axis fixed against translational movement with respect to said one or more leave members, said hinge pin member having a second portion on said longitudinal axis slidable transversely within a corresponding respective slot in said second hinged member while interlocking means acting between said first and second hinged members are pivoted out of engagement from each other, said interlocking means acting to eliminate said transverse sliding of said second portion when said interlocking means are engaged with each other.

15. The apparatus of claim 14, in which said hinge pin member is a rod removable from said first and second hinged members.

16. A collapsible container including a base member, a sidewall member, and a hinge pin member operatively retaining said base member and said sidewall member in a hinged relationship with each other, said hinge pin member being disposed in axially aligned slots formed in said base member and in axially aligned holes in said sidewall member, further including interfitting mortise and tenon members on said base member and said sidewall member interengageable by rotating said sidewall member into an erect position and without translating said hinge pin member away from said base member, said axially aligned slots permitting said hinge pin member and said sidewall member to slide transversely with respect to said axis of alignment of said holes and with respect to said base member when said mortise and tenon members are not engaged with each other, said interfitting members being configured to limit said transverse sliding of said hinge pin member and said sidewall member with respect to said base member when said sidewall member is erected into an upright position.

17. The collapsible container of claim 14, in which said hinge pin member for hinging each said sidewall member to said base member constitutes a non-permanent engaging means between said base member and said sidewall member.

18. A collapsible container assembly including a base member and at least one pair of opposing sidewall members interchangeable with each other, and one or more hinge pin members for operatively retaining each of said sidewall members in a hinged relationship with said base member, said one or more hinge pin members each having a longitudinal axis with first and second portions of said one or more hinge pin members on said axis, said first and second portions fixed against translational movement with respect to each of said respective sidewall members, including means to permit said second portion of said one or more hinge pin members to engage said base member and-move transversely relative to said base member when each said respective sidewall member is not erected, said sidewall members configured and sized to overlap each other when said sidewall members are rotated about said one or more hinge pin members toward said base member, further including interfitting members on said base member and said sidewall members, said interfitting members being configured to engage each other and restrict said transverse sliding of said one or more hinge pin members when each said respective sidewall member is erected into an approximately orthogonal relationship with said base member.

19. The collapsible assembly of claim 18, in which said one or more hinge pin members are disposed in axially aligned holes formed in said base member and each of said at least one pair of opposing sidewall members, said axially aligned holes including slots in said base member to permit said one or more hinge pin members to slide transversely with respect to said axis of alignment of said holes.

20. The collapsible assembly of claim 18 or claim 19, in which said one or more hinge pin members for hinging each said sidewall member to said base member constitutes a non-permanent engaging means between said base member and said sidewall member.

21. A method for collapsing a container, including: providing a container having a plurality of sidewall members and hinge means hinging said sidewall members to a base member, said container including latch members engaging said sidewall members with each other in an erected position, said hinge means permitting said sidewall members to be collapsed into a stacked relationship parallel with a bottom surface of said container overlapping each other in any of a plurality of orders, said hinge means including at least one leave member formed in at least one of said sidewall members, said at least one leave member including a hole therein, said hinge means further including a hinge pin member disposed through a slot in said bottom and through said hole, said hinge pin member being slidable within said slot to permit translational movement of said at least one sidewall member with respect to said bottom when said at least one sidewall member is in other than its erect position and to permit said at least one sidewall member to be pivoted relative to said bottom at a plurality of positions along said slot, said container including interlocking means between said bottom and one or more of said sidewall members to eliminate translational movement between said one or more sidewall members and said bottom when said one or more sidewall members are in said erect position, said interlocking means between said one or more sidewall members and said bottom being disengaged by rotation of said one or more sidewall members toward said bottom and not requiring translational movement of said sidewall members with respect to said bottom to achieve said disengagement, said sidewall members being in their erect and engaged position; disengaging said latch members to disengage said sidewall members from each other; and rotating at least one of said disengaged sidewall members toward said parallel position overlying said bottom.

22. A method for collapsing a container, including:

providing a container having a plurality of sidewall members and hinge means hinging said sidewall members to a base member, said container including latch members engaging said sidewall members with each other in an erected position, said hinge means permitting said sidewall members to be collapsed into a stacked relationship substantially parallel with a bottom surface of said container overlapping each other in any of a plurality of orders, said hinge means including at least one leave member formed in at least one of said sidewall members, said at least one leave member including a hole therein, said hinge means further including a hinge pin member disposed through a slot in said bottom and through said hole, said hinge pin member being slidable within said slot to permit translational movement of said at least one sidewall member with respect to said bottom when said at least one sidewall member is in other than its erect position and to permit said at least one sidewall member to be pivoted relative to said bottom at a plurality of positions along said slot, said container including interlocking means between said bottom and one or more of said sidewall members to eliminate translational movement between said one or more sidewall members and said bottom when said one or more sidewall members are in said erect position, said interlocking means between said one or more sidewall members and said bottom being disengaged by rotation of said one or more sidewall members toward said bottom and not requiring translational movement of said sidewall members with respect to said bottom to achieve said disengagement, said sidewall members being in their erect and engaged position;

disengaging said latch members to disengage said sidewall members from each other; and rotating at least one of said disengaged sidewall members toward said substantially parallel position overlying said bottom.

23. A collapsible container having a base member and a plurality of sidewall members hinged to said base member, said sidewall members being movable between a first erect position and a second overlapping collapsed position, said second position being one in which said sidewall members are in planes generally parallel with each other and at least one pair of opposing said sidewall members overlap each other, including hinge means for hinging each said sidewall member to said base member, said hinge means permitting said sidewall members to be collapsed into said overlapping position in various orders, said hinge means including one or more pin members fixed against translational movement with respect to at least one of said sidewall members, said one or more pin members each having a single respective longitudinal axis, with a respective portion of each of said one or more pin members on said respective longitudinal axis being disposed in a respective slot on said base member, said one or more pin members being slidable within said respective slots to permit said at least one sidewall member to be pivoted relative to said base member at any of a range of positions along said slot, further including at least one latch member acting between adjacent sidewall members to interlock said adjacent sidewall members to each other in said erect position; said at least one latch member positioned and configured so that disengagement of said at least one latch member results in disengagement of said adjacent sidewall members from each other without translating either of said adjacent sidewall members with respect to said base member, and said hinge means is configured to permit said at least one sidewall member to pivot toward said base member upon disengagement of said at least one latch member, without first translating said at least one sidewall member away from said base member.

* * * * *